US007171789B2

(12) United States Patent
Lucey et al.

(10) Patent No.: US 7,171,789 B2
(45) **Date of Patent: *Feb. 6, 2007**

(54) SHEAR WALL CONSTRUCTION

(75) Inventors: Robert Donald Lucey, Lafayette, CA (US); Ronald F. Nelson, Redondo Beach, CA (US)

(73) Assignee: Zone Four, LLC, Perris, CA (US)

( * ) Notice: Subject to any disclaimer, the term of this patent is extended or adjusted under 35 U.S.C. 154(b) by 69 days.

This patent is subject to a terminal disclaimer.

(21) Appl. No.: 10/995,639

(22) Filed: Nov. 22, 2004

(65) Prior Publication Data

US 2005/0072117 A1 Apr. 7, 2005

Related U.S. Application Data

(63) Continuation of application No. 10/357,167, filed on Jan. 31, 2003, now Pat. No. 6,826,882, which is a continuation of application No. 10/122,957, filed on Apr. 12, 2002, now Pat. No. 6,564,519, which is a continuation of application No. 09/479,314, filed on Jan. 6, 2000, now Pat. No. 6,389,767.

(51) Int. Cl.
*E04C 2/34* (2006.01)

(52) U.S. Cl. ..... 52/481.1; 52/295; 52/745.09; 52/293.1

(58) Field of Classification Search ..... 52/295, 52/272, 741.1, 745.09, 293.1, 299, 223.1, 52/481.1, 712, 714, 210, DIG. 10
See application file for complete search history.

(56) References Cited

U.S. PATENT DOCUMENTS 1,054,175 A 2/1913 Coffin
1,474,660 A 11/1923 White
2,281,402 A 4/1942 Wilson, Jr. et al.
2,316,425 A 4/1943 Hasenburger et al.
2,692,408 A 10/1954 Connor
3,224,533 A 12/1965 Nystrom
3,264,021 A 8/1966 Artman (Continued)

FOREIGN PATENT DOCUMENTS

DE 0476638 9/1991

(Continued)

OTHER PUBLICATIONS

Letter from ICBO Evaluation Service, Inc. to Robert Lucey, Feb. 27, 1998.

(Continued)

*Primary Examiner*—Naoko Slack
*Assistant Examiner*—Chi Q. Nguyen
(74) *Attorney, Agent, or Firm*—Knobbe Martens Olson & Bear LLP

(57) ABSTRACT

A shear wall construction and method for assembling the same is disclosed. A plywood sheet includes close laterally-spaced pairs of vertical studs or posts proximate each lateral end. A channel-defining member is fitted and fixed between the spaced studs. A tie member extends from the channel-defining member into a concrete foundation or other underlying building element. A track is also provided for sheathing a lower edge of the shear wall. Protrusions from the metal track aid in anchoring the shear wall to the concrete foundation.

20 Claims, 7 Drawing Sheets

U.S. PATENT DOCUMENTS

| | | | |
|---|---|---|---|
| 3,837,754 | A | 9/1974 | Malcik |
| 4,129,975 | A | 12/1978 | Gabriel |
| 4,271,654 | A | 6/1981 | Jungbluth |
| 4,611,948 | A | 9/1986 | Johnson |
| 4,616,950 | A | 10/1986 | Morris |
| 4,701,065 | A | 10/1987 | Otosa |
| 4,893,961 | A | 1/1990 | O'Sullivan et al. |
| 5,092,096 | A | 3/1992 | Cornell |
| 5,228,261 | A | 7/1993 | Watkins |
| 5,249,404 | A | 10/1993 | Leek et al. |
| 5,353,560 | A | 10/1994 | Heydon |
| 5,367,852 | A | 11/1994 | Masuda et al. |
| 5,375,384 | A | 12/1994 | Wolfson |
| 5,575,129 | A | 11/1996 | Goto |
| 5,678,375 | A | 10/1997 | Juola |
| 5,706,626 | A | 1/1998 | Mueller |
| 5,729,950 | A | 3/1998 | Hardy |
| 5,765,333 | A | 6/1998 | Cunningham |
| 5,809,719 | A | 9/1998 | Ashton et al. |
| 5,813,181 | A | 9/1998 | Ashton et al. |
| 5,921,042 | A | 7/1999 | Ashton et al. |
| 6,006,487 | A | 12/1999 | Leek |
| 6,205,725 | B1 | 3/2001 | Butler |
| 6,256,960 | B1 | 7/2001 | Babcock |
| 6,327,831 | B1 | 12/2001 | Leek |
| 6,389,767 | B1 | 5/2002 | Lucey |
| 6,564,519 | B2 | 5/2003 | Lucey et al. |
| 6,826,882 | B2 | 12/2004 | Lucey et al. |

FOREIGN PATENT DOCUMENTS

| | | |
|---|---|---|
| JP | 6-173370 | 6/1994 |

OTHER PUBLICATIONS

Letter from DGS Division of the State Architect, Oct. 26, 1998.

SHEAR WALL CONSTRUCTION

REFERENCE TO RELATED APPLICATIONS

This application is a continuation of U.S. patent application Ser. No. 10/357,167, filed Jan. 31, 2003, now U.S. Pat. No. 6,826,882, which is a continuation of U.S. patent application Ser. No. 10/122,957, filed Apr. 12, 2002, now U.S. Pat. No. 6,564,519 issued May 20, 2003, which is a continuation of U.S. patent application Ser. No. 09/479,314, filed Jan. 6, 2000, now U.S. Pat. No. 6,389,767 issued May 21, 2002, the entire contents of which prior applications are hereby incorporated herein by reference.

BACKGROUND OF THE INVENTION

In the construction of buildings, fabricated wall segments are sometimes built separately and erected on site and are sometimes built on site while coordinated with other aspects of building construction. Fabricated shear walls need to be connected not only to each other but also to underlying and overlying structural elements, such as floors and roofs.

With reference to FIG. 1, a building 10 comprising a plurality of wall sections 11 is schematically illustrated in cross-section. During an earthquake, like any other building structural elements, these wall segments are subject to various stresses. Wall segments 12 near building comers, in particular, are subjected to vertical stresses as the central portions of the wall act as a fulcrum. Because these vertical stresses are directed towards horizontal nailing that hold the structures together, corner wall segments 12 are typically referred to as shear walls 12.

In order to resist stresses to which shear walls 12 are subjected, hold-down devices are often provided to connect the vertical portions of a shear wall 12 to other adjacent building structural elements. While conventional hold-down devices, framing configurations and other connection hardware somewhat assist the ability of shear walls to resist seismic stresses, a need exists for further improvement.

FIELD OF THE INVENTION

The present invention relates generally to shear wall constructions, and more particularly to methods and structures for vertically tying fabricated shear wall segments through floor and ceiling structures.

SUMMARY OF THE INVENTION

In satisfaction of this need, the present invention provides a shear wall construction that includes close laterally-spaced pairs of vertical studs or posts on each lateral side of a shear wall sheet (e.g., plywood). A channel-defining member is fitted between and affixed to the spaced studs. A tie member extends from the channel-defining member into a vertically-adjacent building structural element.

The channel-defining member generally comprises metal or other structural material, and defines a longitudinal channel generally parallel to the studs. In the illustrated embodiments, the member is a generally tubular element, though in other arrangements the member can comprise a generally C- or U-shaped element. The preferred tie member is a threaded rod that extends from an end plate of the channel-defining member and into a concrete foundation or floor. Similar constructions are provided at opposite lateral ends of the shear wall, such that the shear wall can better resist seismic forces.

Additionally, the preferred embodiments provide a bottom track for aiding and reinforcing the vertical connection. In particular, the bottom track comprises two longitudinal flanges with a plurality of fastener holes therein, and a central longitudinal portion having punched-through holes. The punched-through holes provide downwardly extending protrusions.

In operation, the bottom track is positioned over a concrete form with the flared protrusions from the punched-through holes extending downwardly into a region in which a concrete floor will be formed. Similarly, the tie members extend through the track into the concrete form. Concrete is then allowed to harden around the tie member and track protrusions, such that the bottom track is secured to the concrete floor. The shear wall is then erected over the track and flanges are folded up and fixed to sheat the bottom edge of the shear wall.

BRIEF DESCRIPTION OF THE DRAWINGS

These and other aspects of the invention will be readily apparent from the detailed description below and from the attached drawings, meant to illustrate and not to limit the invention, and wherein.

DETAILED DESCRIPTION OF THE PREFERRED EMBODIMENT

Although described with reference to preferred embodiments in the context of shear walls over concrete foundations, the skilled artisan will readily find application for the methods and structures disclosed in other contexts. For example, and without limitation, the methods and structures can be readily applied to tying shear walls through floors between stories in a building, as described in more detail with respect to FIG. 7.

Figure 1:
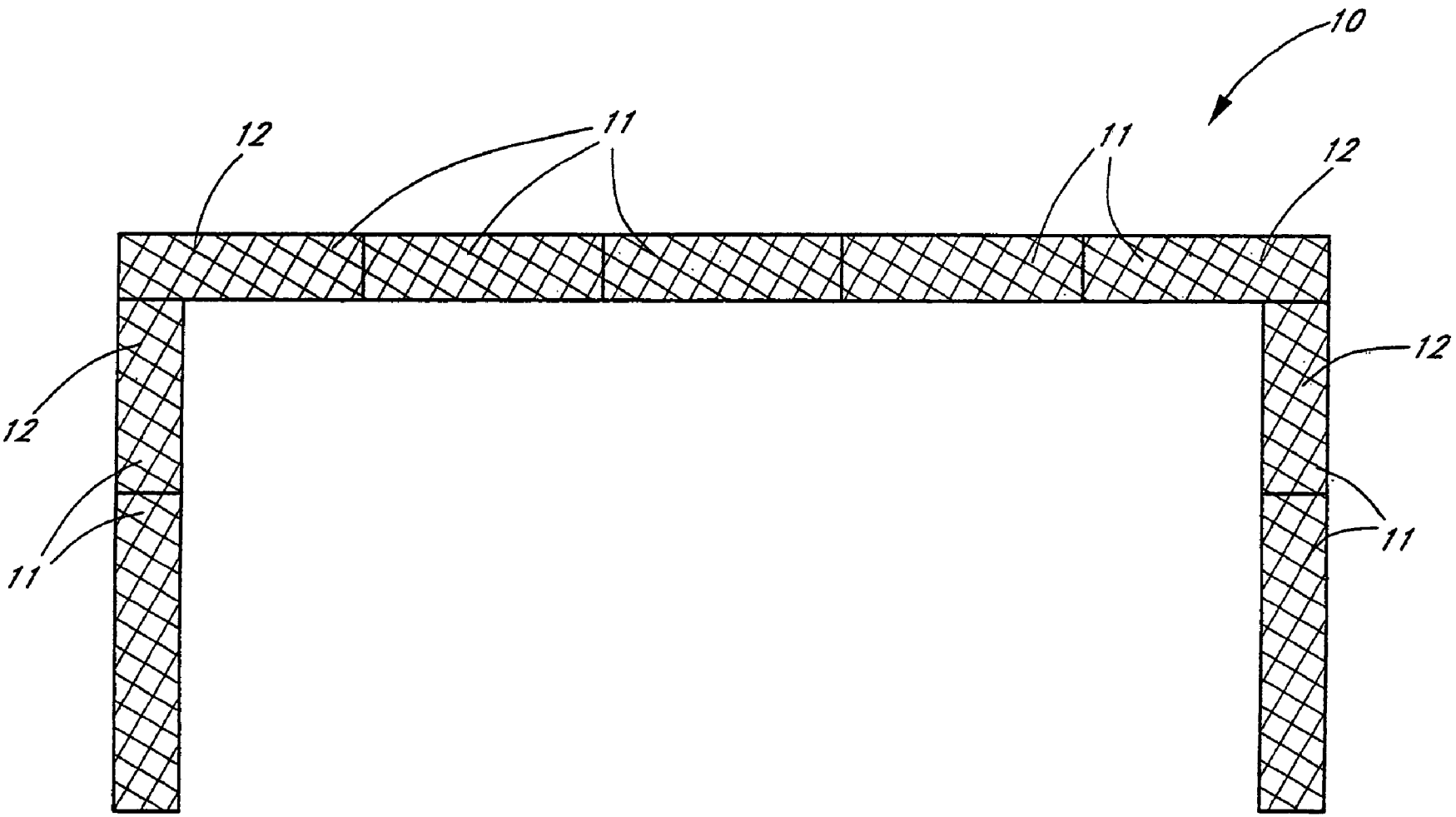
FIG. 1 is a schematic horizontal cross section of a portion of a building having segmented walls.
Figure 2A:
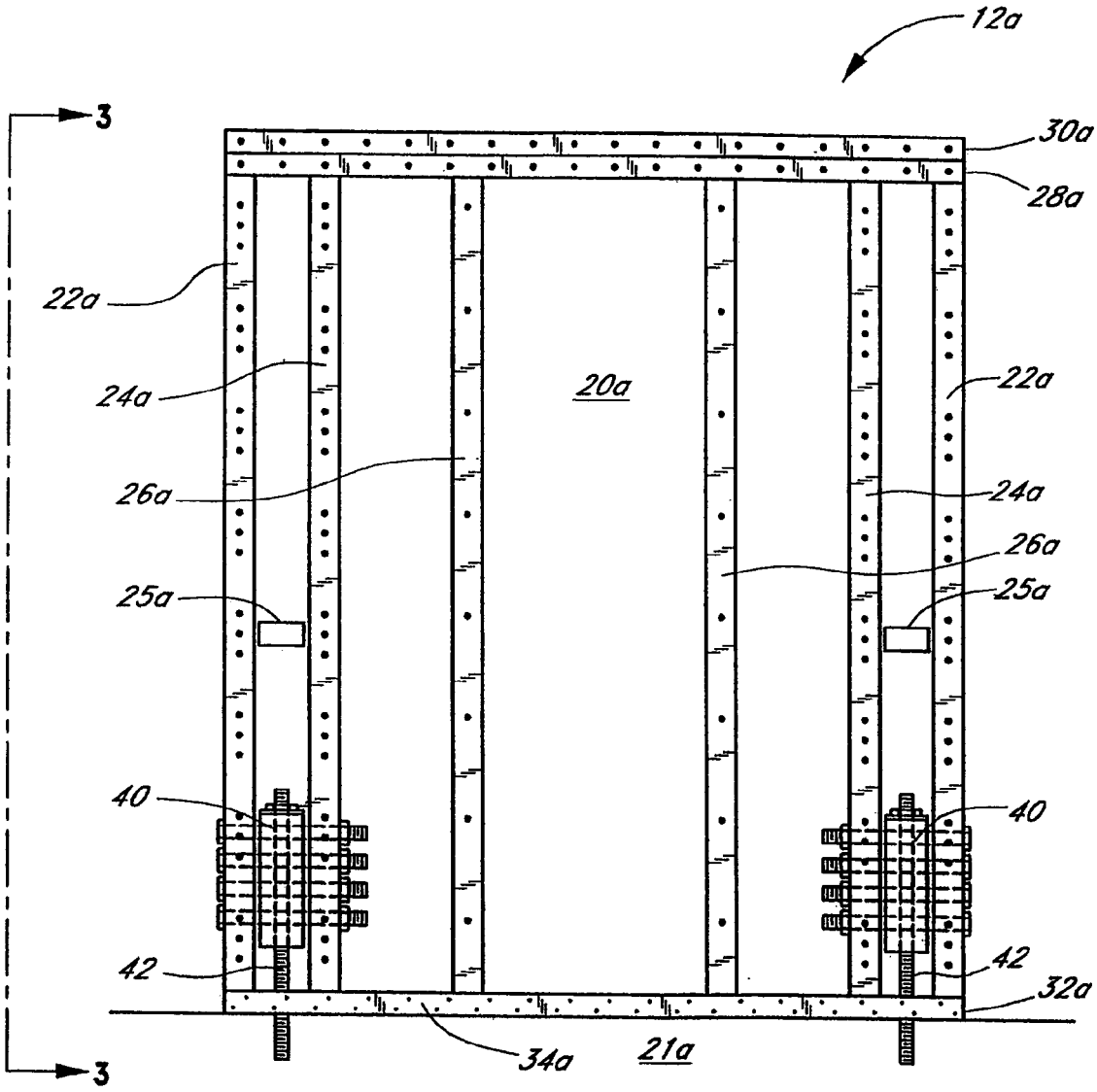
FIG. 2A is a rear elevational view of a pre-fabricated shear wall constructed in accordance with a first embodiment of the present invention.
Figure 3:
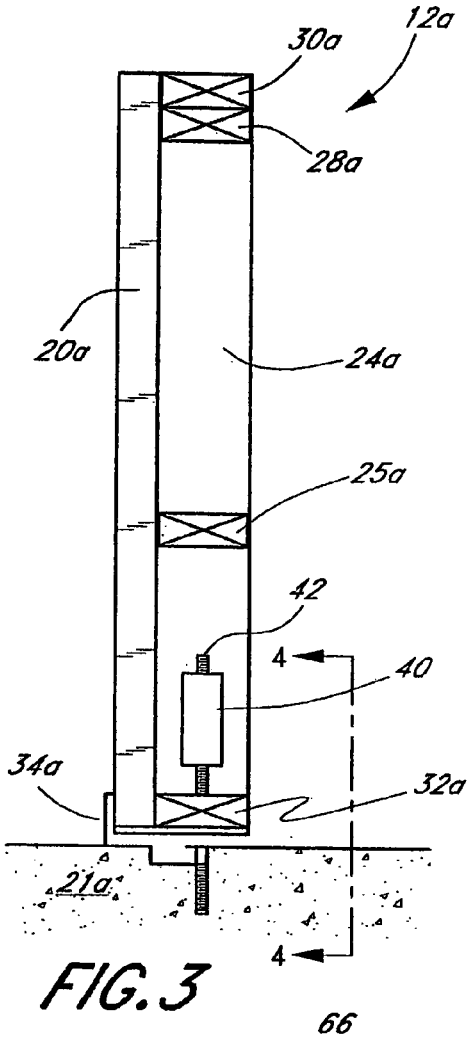
FIG. 3 is a side elevational cross-section taken along lines 3—3 of FIG. 2A.

With reference now to FIGS. 2A and 3, a shear wall 12*a* is illustrated in accordance with a first preferred embodiment. The shear wall 12*a* includes a sheet of wall material, which in the illustrated embodiment comprises plywood having dimensions of about 4 feet (width) by 8 feet (height). The shear wall 12*a* is shown erected over and tied down to a vertically-adjacent structural element, in the illustrated embodiment comprising a concrete foundation 21*a*. In other arrangements, as noted, the vertically-adjacent structural element can comprise a floor between stories of a building, and the shear wall can also be tied through a floor to a second shear wall in a lower story.

The wall sheet 20*a* is reinforced by end studs or posts 22*a* running longitudinally along the height of the rear or back side of the shear wall 12*a*. One such end stud 22*a* is shown at each lateral end of the shear wall 12*a*, nailed into the plywood sheet 20*a* along its length at preferred nail spacings between about 2 inches and 6 inches (about 4 inches shown). In the illustrated embodiment, each of the studs 22*a* comprise "2 by 4" timbers (actual dimensions about 1.5 inches by 3.5 inches).

The shear wall 12*a* also includes an offset stud or post 24*a* extending parallel and spaced laterally inward from each of the end studs 22*a*, on the same side of the wall sheet 20*a*. The offset stud 24*a* also comprises a 2-by-4 timber in the illustrated embodiment, nailed along its length to the plywood sheet 20*a*. Desirably, the offset studs 24*a* are close to the end studs 22*a* so as to effectively transfer loads at the shear wall corners, but sufficiently spaced from their corresponding end studs 22*a* so as to independently transfer loads to the plywood sheet 20*a*. Preferably, the studs 22*a* and 24*a* are spaced by between about 1 inch and 6 inches, more preferably between about 2 inches and 3 inches. In the illustrated embodiment, the studs 22*a* and 24*a* are spaced by about 3 inches. Reinforcing blocks 25*a* (1.5"×3.5"×3") are also shown between the studs 22*a* and 24*a*, located about a quarter of the height up the shear wall 12*a*.

Preferably, further stiffening is provided by intermediate studs or posts 26*a* between the spaced pairs of studs 22*a*, 24*a* proximate the lateral ends of the shear wall 12*a*. Nailing can be less dense for the intermediate studs 26*a*, and is shown with 12 inches between nails. In the illustrated embodiment, these intermediate studs 26*a* are spaced from each other and from the lateral ends studs 22*a* by about one third of shear wall width, or 16 inches for the 4' by 8' wall shown.

Extending over the tops of the studs 22*a*, 24*a*, 26*a* is a top plate. In the illustrated embodiment, the top plate comprises two stacked plates, 28*a* and 30*a*, which also aids in stiffening the shear wall 12*a*. In the illustrated embodiment, the plates 28*a* and 30*a* each comprise 2-by-4 timbers (actual dimensions about 1.5 inches by 3.5 inches).

A similar bottom plate or sill 32*a* extends below the bottoms of the studs 22*a*, 24*a*, 26*a*. The bottom plate 32*a* preferably sits within a bottom track 34*a*, which wraps around the bottom, front and back of the plate 32*a*, as best seen from the sectional view of FIG. 3. As illustrated, the track 34*a* is preferably nailed along the back of the bottom plate 32*a* and the front of the plywood sheet 20*a*. The track 34*a* is fixed to the underlying concrete foundation 21*a*, as described in more detail with respect to FIGS. 3–5.

Referring again to FIG. 2A, a channel-defining member 40 and a tie member 42 tie the shear wall 12*a* to the vertically-adjacent building structural element 21*a*, at each lateral end of the shear wall 12*a*. The channel-defining member 40 is fixed between the closely spaced end stud 22*a* and offset stud 24*a*, while the tie member 42 is fixed to and extends between the channel-defining member 40 and the vertically adjacent building structural element 21*a*. The channel of the channel-defining member 40 and tie member 42 each extend generally parallel with the studs 22*a* and 24*a* between which the member 40 is sandwiched. The channel-defining member 40 and tie member 42 will be described in more detail below with respect to FIG. 4 below.

Figure 2B:
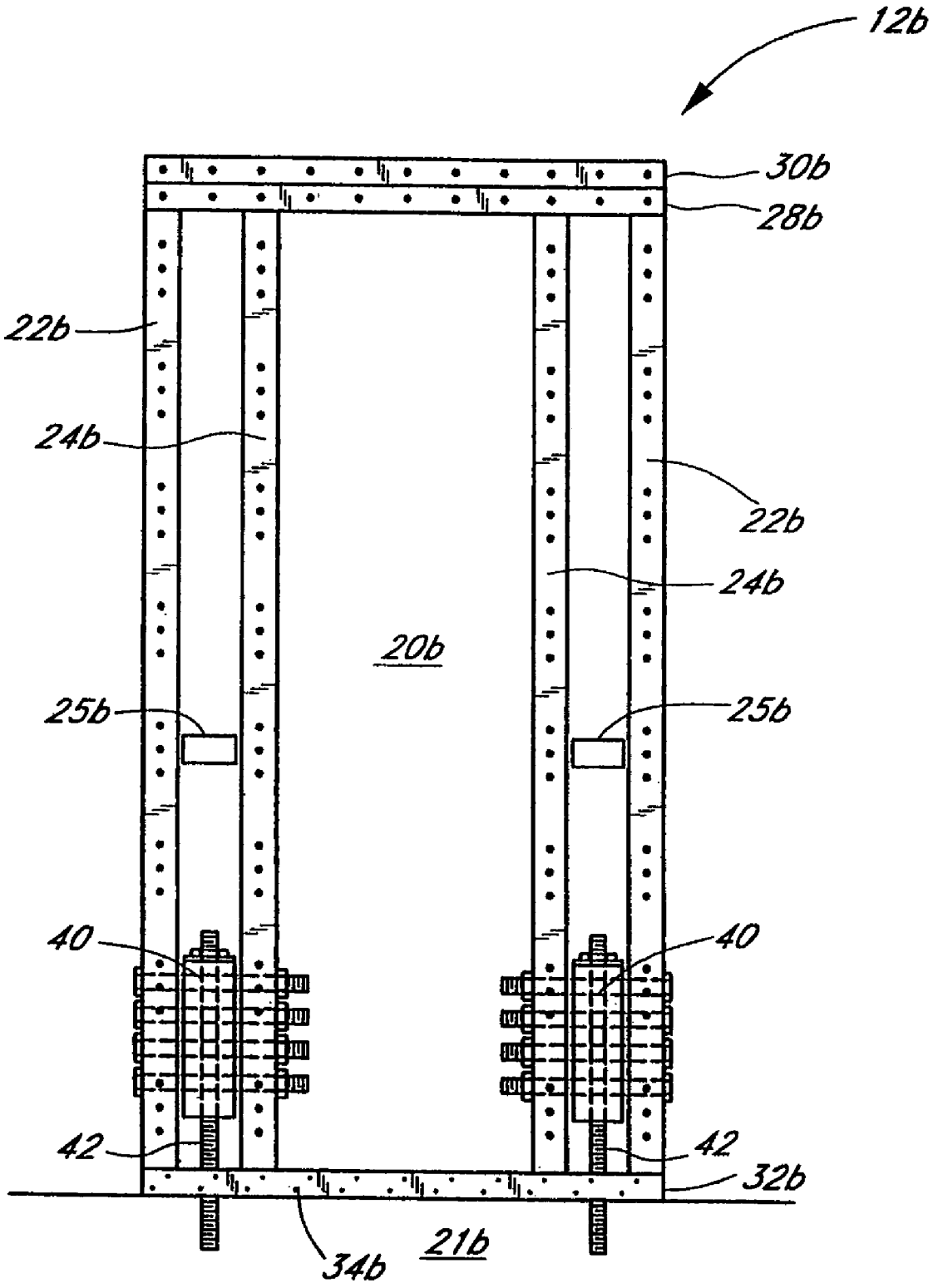
FIG. 2B is a rear elevational view of a shear wall constructed in accordance with a second embodiment of the present invention.

With reference now to FIG. 2B, a shear wall 12*b* is illustrated in accordance with a second preferred embodiment. The second embodiment is similar to the first embodiment. Accordingly, like parts are referenced by like reference numerals, with the exception that reference numerals of corresponding parts include the suffix "b" in place of the suffix "a".

The basic difference between the shear wall 12*a* of the first embodiment and the shear wall 12*b* of the second embodiment is that the illustrated shear wall 12*b* has dimensions of about 2 feet by 8 feet, rather than 4 feet by 8 feet. Due to its narrower dimensions, the shear wall 12*b* does not include intermediate studs. The construction can be otherwise identical to that of the first embodiment, with commensurate dimensional changes in corresponding elements in the horizontal dimension.

Figure 2C:
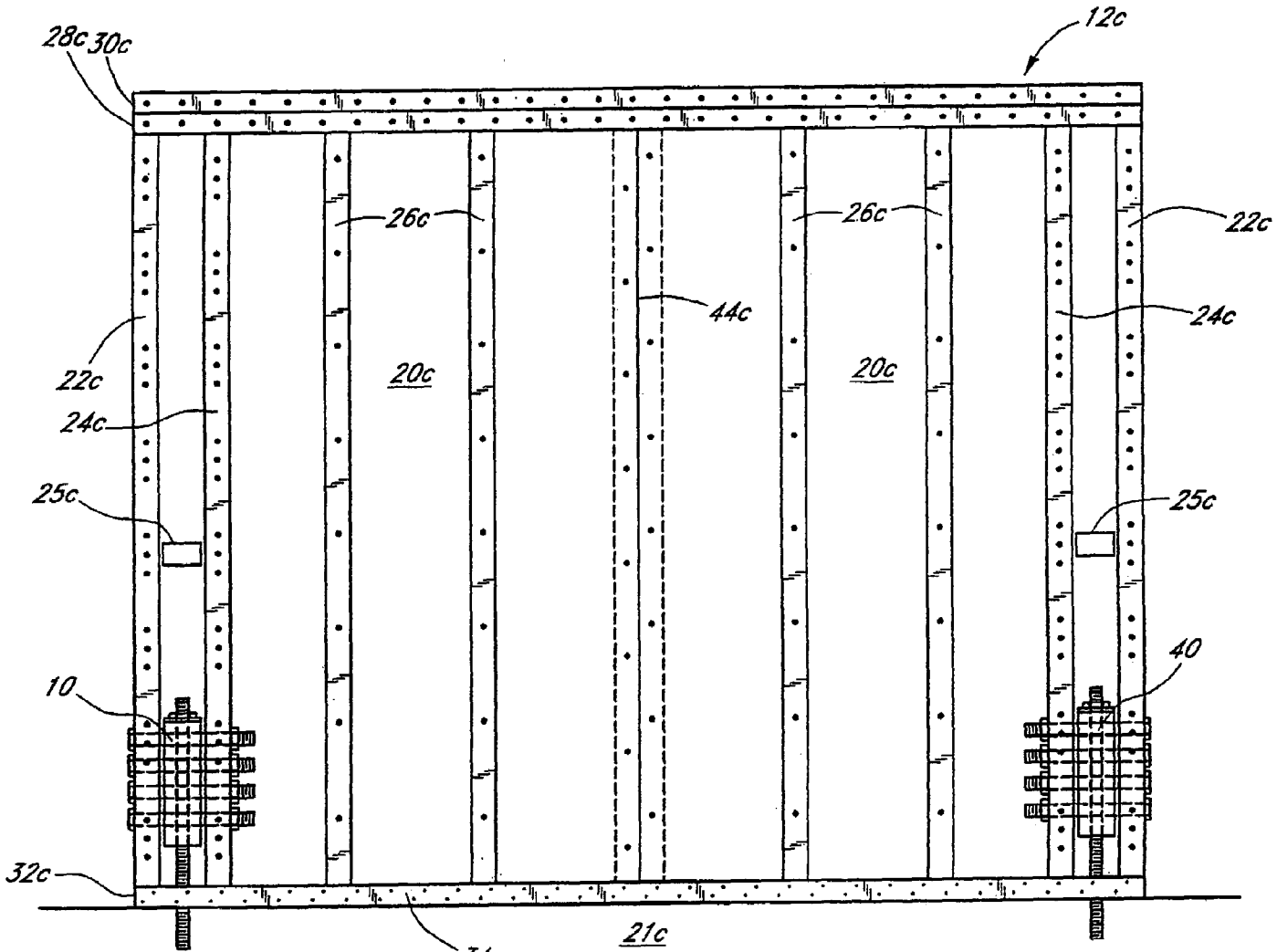
FIG. 2C is a rear elevational view of two spliced shear wall panels, constructed in accordance with a third embodiment of the present invention.

With reference now to FIG. 2C, a shear wall 12*c* is illustrated in accordance with a third preferred embodiment. The third embodiment is similar to the first and second embodiments. Accordingly, like parts are referenced by like reference numerals, with the exception that reference numerals of corresponding parts include the suffix "c" in place of the suffixes "a" or "b".

The shear wall 12*c* of the third embodiment comprises two sheets 20*c*, each comprising a sheet of plywood (e.g., 4 feet by 8 feet), joined at a plywood splice 44*c*. The wall 12*c* thus has overall dimensions of 8 feet by 8 feet. The splice 44*c* can have a conventional construction, but in the preferred embodiment includes a strap, e.g., about 4 inches wide, overlapping both sheets 20*c* along the front side. The strap is alternately fastened, in staggered fashion along the height of the wall 12*c*, to each of the sheets 20*c*, preferably by nailing. Each sheet 20*c* includes two intermediate studs 26*c*, similar to those of the first embodiment. The construction can be otherwise identical to that of the first embodiment, with commensurate dimensional changes in corresponding elements in the horizontal dimension.

Figure 4:
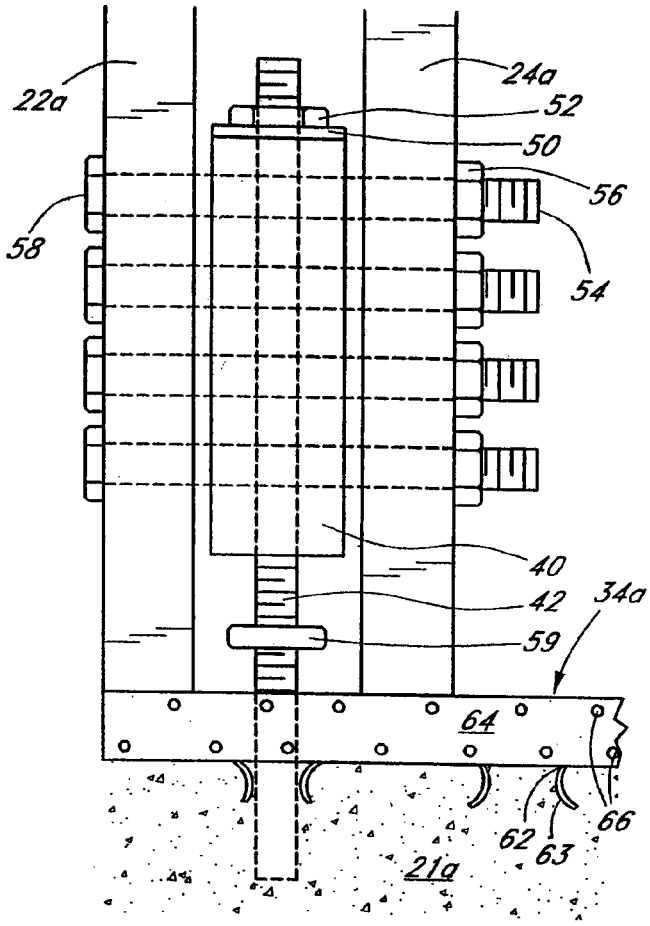
FIG. 4 is an enlarged view of a lower corner of a shear wall constructed in accordance with the preferred embodiments, showing a channel-defining member sandwiched between two closely spaced studs and having a threaded member extending from the channel-defining member through a concrete floor.

With reference now to FIG. 4, an enlarged view is provided of a corner of the shear wall 12*a* and the vertically-adjacent building structural member 21*a*. The channel-defining member 40 defines a longitudinal channel and a mounting platform extending across the channel, both preferably comprising a heavy structural material. In the illustrated embodiment, the member 40 comprises a generally tubular member commercially available from Zone Four, LLC of San Leandro, Calif. under the trade name Tension Tie™ or T2™. A similar structure is referred to as a "Continuity Tie" in U.S. Pat. No. 5,921,042 ("the '042 patent"), the disclosure of which is expressly incorporated herein by reference. Unlike the Continuity Tie™ of the '042 patent, the illustrated member 40 includes only one end plate 50, and the tie member 42 is centered relative to the channel-defining member 40, rather than offset. The illustrated channel-defining member 40 comprises ⅛-inch tube steel, formed into a 3" by 3" square cross-section tube of about six inches in length. The illustrated end plate 50 comprises a 3" by 3.5" plate of ⅜-inch steel welded to the tube steel.

The skilled artisan will readily appreciate that the channel-defining member 40 can have other constructions without departing from the spirit of the present invention. For example, in alternative arrangements, the channel-defining member can be a C-shaped or U-shaped member, and in such arrangements the channel can open inwardly (toward the sheet 20*a*), outwardly or to one side (toward one of the studs 22*a,* 24*a*). Advantageously, the hollow configuration facilitates connection, as will be understood from the disclosure herein. In still other arrangements, the channel-defining member can be replaced by a solid block or plate of material capable of being connected between studs and to vertically-adjacent structures as described herein, in which case no separate mounting platform would be employed. Additionally, the mounting platform can comprise an end plate on the lower end of the channel-defining member; two end plates; or an intermediate plate, bar orplurality of bars extending across the channel between the ends of the channel-defining member.

The tie member 42 preferably comprises a tension-resistant member, particularly a threaded rod in the illustrated embodiment. The tie member 42 comprises a structural material, such as forged steel, having a diameter preferably between about 0.25 inch and 2 inches, and is about 0.75 inch in the illustrated embodiment. In other arrangements, the tension-resistant member can comprise a cable. The illustrated tie member 42 is fixed to the end plate 50, preferably by extending through a mounting aperture centered in the end plate 50 and applying a nut 52 on the distal or upper side of the end plate 50. The illustrated tie member 42 extends from the end plate 50, connected in tension-resistant manner on the upper side of the end plate 50, through the channel of the channel-defining member 40, through the bottom plate 32*a* and bottom track 34*a,* and into the concrete foundation 21*a.* If the mounting platform is located at the lower end or at an intermediate location in the channel-defining member, the nut is still located on the distal side of the channel-defining member, but within the channel. In such an arrangement, the hollow, tubular nature of the channel-defining member particularly facilitates access for the connection. The illustrated tie member 42 includes two coaxial members joined by a coupler 59, as will be better understood from the discussion of assembly below.

While the illustrated channel-defining member 40 and tie member 42 form a tension-resistant connection, for some applications the connection can be tension- and compression-resistant. For this purpose, modification of the illustrated embodiment, where the tie member 42 comprises a stiff rod, can involve simple addition of a second nut on the proximal or bottom side of the end plate 50. More preferably, tension and compression-resistance can be further enhanced by addition of a second mounting platform, such as a second end plate with nuts on the bottom or both sides fixing the tie member to the second end plate. The tie member 42 can attach at the mounting platform by any suitable manner (e.g., welding, looping, nut and washer, etc.).

As noted, the channel-defining member 40 is fixed to each of the end stud 22*a* and offset stud 24*a* between which it is sandwiched. As disclosed in the '042 patent, bolts holes in the channel-defining member 40 sidewalls are preferably staggered on either side of the tie member 42 that extends through the channel. A plurality of bolts 54 extend through each of the end stud 22*a,* the bolt-mounting apertures of the channel-defining member 40 and the offset stud 24*a.* The bolts 54 are then affixed by nuts 56, preferably on the side of the offset studs 24*a,* while bolt heads 58 preferably abut the end studs 22*a.* As will be appreciated by the skilled artisan, in other arrangements, the channel-defining member can be fixed to the studs 22*a,* 24*a* by means of other fasteners, such as nails, screws, rivets, etc.

Figure 5:
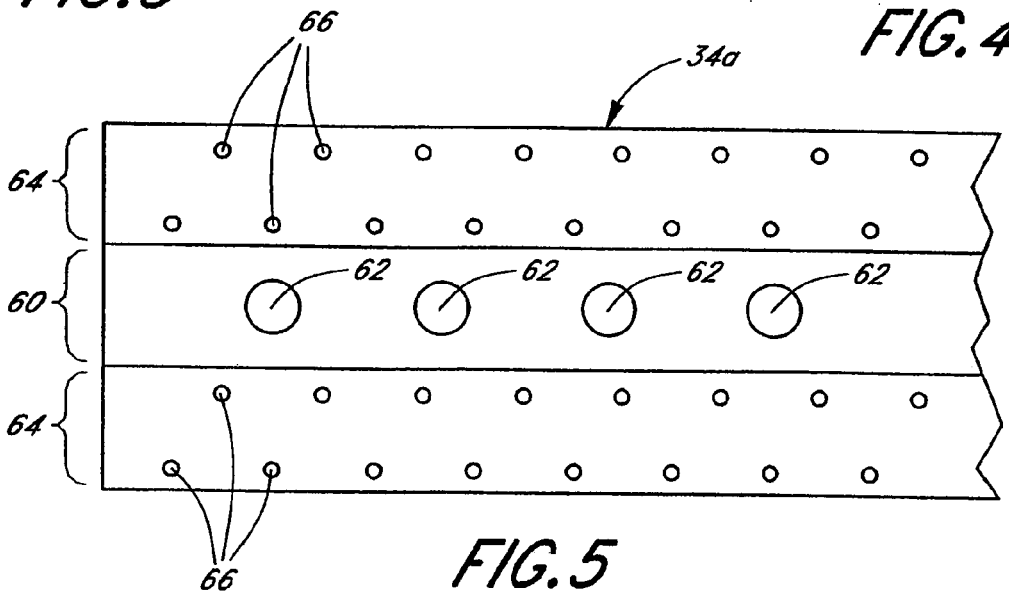
FIG. 5 is a partial plan view of a bottom track for sheathing the lower sill of a shear wall, constructed in accordance with a preferred embodiment of the present invention, prior to assembly.

With reference now to FIGS. 3–5, the bottom track 34*a* is illustrated in more detail. For purposes of the present description, the longitudinal dimension of the track 34*a* extends across the lateral dimension of the shear wall 12*a* when assembled.

Referring initially to FIG. 5, the track 34*a* is shown prior to assembly, comprising a strip of sheet metal, preferably between about 10 gauge and 30 gauge steel (16 gauge in the illustrated embodiment). The unassembled track 34*a* of FIG. 5 illustrates three lateral zones, preferably separated by fold creases.

A first or central zone 60 comprises a plurality of longitudinally separated through holes 62. Desirably, the central zone 60 is wide enough to underlie the bottom plate 42 and sheet 20*a* (see FIG. 3). As best seen from the sectional view of an assembled shear wall in FIG. 4, the through holes 62 are formed by punching holes through the sheet metal, such that protrusions or flares 63 left by the punching process extend below the track 34*a.* The punched-through holes 62 preferably have a width or diameter between about 0.25 inch and 3 inches, more preferably between about 1 inch and 1.5 inches. The holes 62 are preferably spaced by between about 1 inch and 12 inches, about 4 inches in the illustrated embodiment. Through holes 62 at longitudinal ends of the track 34*a,* corresponding to lateral ends of the shear wall 12*a,* are preferably located to serve as templates for placement of the tie member 42, as will be better understood from the discussion of assembly below.

Referring again to FIG. 5, the unassembled track 34*a* also comprises sidewall zones 64 on either lateral side of the central zone 60. Each sidewall zone 64 preferably comprises a plurality of fastener holes 66. As will be appreciated by the skilled artisans, such fastener holes 66 preferably have diameters between about 0.1 inch and 0.25 inch to facilitate nailing therethrough. In the illustrated embodiment, the fastener holes 66 are staggered between upper and lower portions of the sidewalls 64 to distribute stress.

Figure 6:
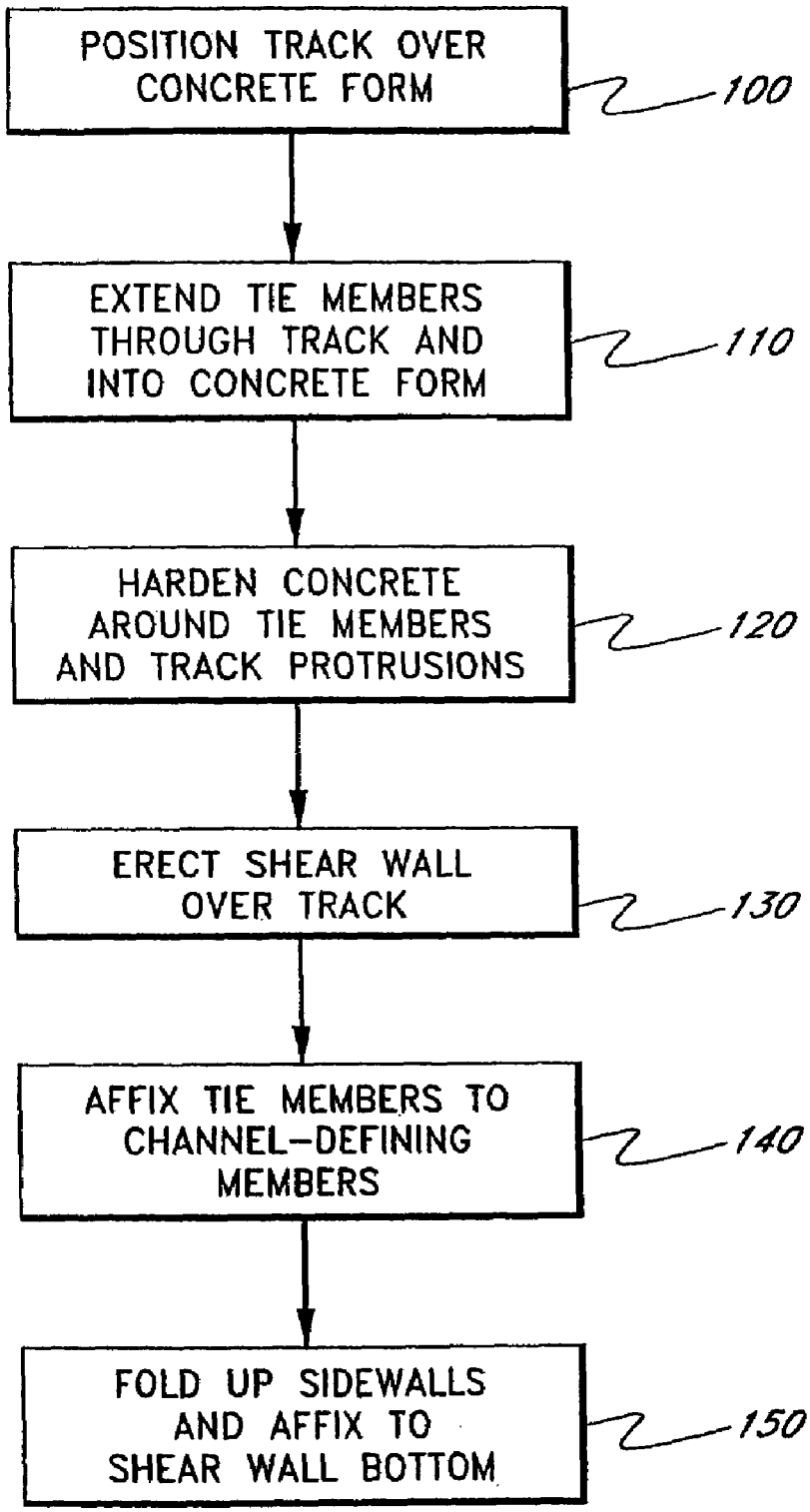
FIG. 6 is a flow chart generally illustrating a method of assembling the preferred shear wall construction.

With reference to FIGS. 4 and 6, a preferred method of assembling the shear 12*a* will now be described. Initially, partial building construction leaves a frame or opening for the shear wall 12*a* and a concrete form for the floor 21*a.* The track 34*a* is then positioned 100 and preferably temporarily fixed over the concrete form, either before pouring the concrete or after pouring and before hardening ("wet set"). In either case, the protrusions or flares 63 extend downwardly from the through holes 62 into wet concrete. At the same time, the tie members 42 are preferably extended 110 through selected through holes 62 at longitudinal ends of the track 34*a,* into the concrete form (also either prior to pouring or wet set within the concrete), protruding upwardly a few inches above the track 34*a.* The concrete is allowed to harden 120 around the protrusions 63 and the tie member 42.

The shear wall 12*a* is then erected 130 over the track 34*a.* The skilled artisan will appreciate that the wall 12*a* can be assembled during construction (on site assembly) or prior to erection 130 and tying to other elements of the building (pre-manufactured assembly).

With reference to the embodiment of FIGS. 2A, 4 and 6, pre-manufactured assembly involves affixing the end and offset studs 22*a,* 24*a,* any intermediate studs 26*a,* top plates 28*a,* 30*a* and bottom plate 32*a* to the sheet 20*a,* preferably by nailing as described above. Desirably, holes are drilled in appropriate spots for extending the tie members 42 therethrough. The channel-defining member 40 is bolted between the spaced pair of studs 22*a,* 24*a.* Once assembled, the pre-manufactured shear wall 12*a* can then be lifted or erected 130 into place over the track 34*a.* The tie members 42 protrude upwardly through holes in the bottom plate 32*a.* These tie members 42 can then be affixed 140 to the channel-defining member 40, such as by coupling an extension to the portion of the members protruding through the track 34*a* and bottom plate 32*a*, and then threading the nut 52 over the member 42 until engaging the end plate 50.

An exemplary on site assembly, in contrast, involves first assembly the outside or end studs 22*a*, top plate 28*a*, 30*a* and bottom plate 32*a*. This structure can be lifted into place within the frame or opening for the shear wall 12*a*, with the tie member 42 protruding upwardly through holes in the bottom plate 32*a*, and the shear wall 12*a* is braced in position. The channel-defining members 40 can be temporarily nailed in place inside the end studs 22*a* while bolt holes are drilled through the studs 22*a*. The offset studs 24*a* are then inserted into the framework adjacent the channel-defining members 40, the studs 24*a* are toe-nailed into the plates 28*a*, 32*a*, and bolt holes are drilled through the offset studs 24*a*. The tie member 42 can then be affixed 140 to the channel-defining member 40, such as by coupling an extension to the portion of the member 42 protruding through the member. The wall sheet 20*a* can be last affixed and nailed to the various studs and plates while erected over the track 34*a*.

Referring to FIGS. 4–6, following erection 130 of the shear wall 12*a* and fixing 140 the tie members 42 to the channel-defining members 40, the track 34*a* preferably sheaths 150 the bottom edge of the shear wall 12*a*. In particular, the track 34*a* is folded along longitudinal crease lines separating the central zone 60 from the sidewall zones 64. The sidewall zones 64 are folded up 90° to the central zone 60, thereby forming a generally U-shaped track (see FIG. 3). The sidewall zones 64 are affixed to the sheet 20*a* and bottom plate 32*a*, preferably by nailing through the fastener holes 66.

While the embodiments above are described in the context of connecting a shear wall to a concrete foundation, the skilled artisan will appreciate that teachings herein are also applicable to other contexts.

Figure 7:
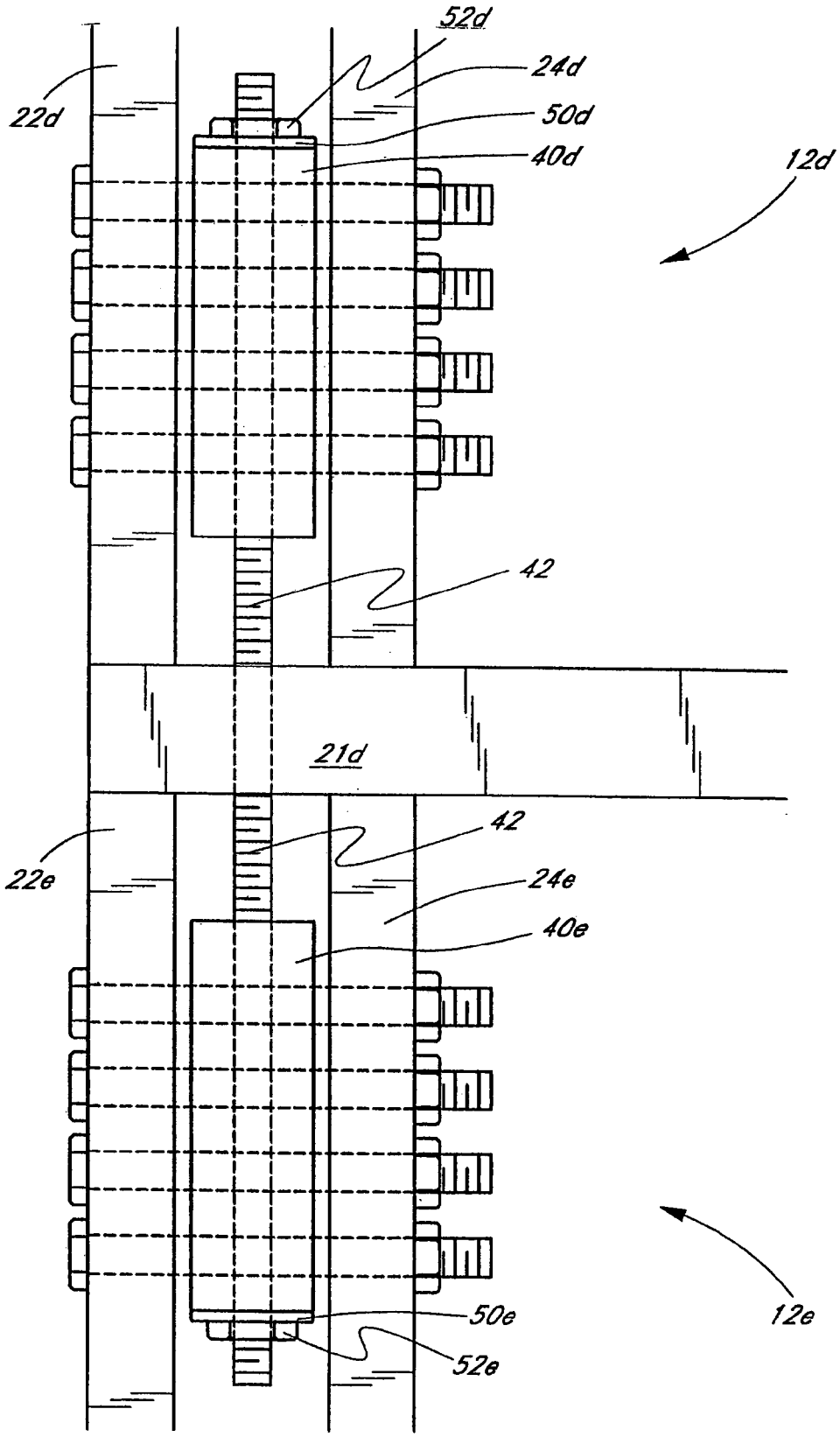
FIG. 7 is an enlarged sectional view of two shear walls connected through a floor.

Referring to FIG. 7, for example, the tie member 42 can be affixed to a mounting platform 50*d* of a first channel-defining member 40*d*, such as by a nut 52*d* on a distal (upper) side of the platform 50*d*. As in the previously described embodiments, the channel-defining member 40*d* is sandwiched between an end post or stud 22*d* and an offset stud 24*d* of a shear wall 12*d*. The tie member 42 can be extended through a floor 21*d* and affixed to a second channel-defining member 40*e* sandwiched between studs 22*e*, 24*e* of a shear wall 12*e* in the story below. The tie member 42 would then be affixed to a mounting platform 50*e* of the second channel-defining member 40*e*, such as by a nut 52*e* on a distal (lower) side of the platform 50*e*. It will be understood that the tie member can be a single, continuous member, or it can comprises a plurality of coupled members (not shown).

Although the foregoing invention has been described in terms of certain preferred embodiments, other embodiments will be apparent to those of ordinary skill in the art. Accordingly, the present invention is not intended to be limited by the recitation of the preferred embodiments, but is instead to be defined by reference to the appended claims.

We claim:

1. A shear wall construction, comprising:

a wall sheet having first and second lateral ends;

a pair of generally vertical spaced studs affixed to a first side of the sheet, a first of the studs being affixed to the sheet at the first lateral end of the sheet, a second of the studs being affixed to the sheet at a position nearer to the first lateral end than to the second lateral end of the sheet; and a stabilizing member sandwiched between and attached to both of the studs, the stabilizing member configured to selectively engage and disengage an elongated tie member oriented generally parallel to the studs such that, when the stabilizing member is engaged with the tie member, movement of the stabilizing member in at least one direction along the tie member is substantially prevented.

2. The shear wall construction of claim 1, wherein the stabilizing member defines a channel extending within the stabilizing member generally parallel to the studs.

3. The shear wall construction of claim 1, wherein the studs are horizontally spaced by between about 1 and 6 inches.

4. The shear wall construction of claim 1, further comprising an elongated tie member extending generally parallel to the studs from the stabilizing member into a vertically adjacent building structural member, the stabilizing member being engaged with the tie member such that movement of the stabilizing member in at least one direction along the tie member is substantially prevented.

5. The shear wall construction of claim 4, wherein the engagement of the stabilizing member with the tie member substantially prevents movement of the stabilizing member in a first direction along the tie member but does not prevent movement of the stabilizing member in a second direction along the tie member, the second direction being substantially opposite from the first direction.

6. A method of constructing a shear wall, comprising:

providing a plywood sheet having first and second lateral ends;

attaching a pair of generally vertical studs, horizontally spaced from one another by between about 1 inch and 6 inches, to one side of the sheet proximate one of the lateral ends of the sheet; and affixing a stabilizing member to both of the studs, the stabilizing member including a mounting platform configured to mount an elongated tie member oriented generally parallel to the studs such that, when the tie member is mounted on the mounting platform, movement of the stabilizing member in at least one direction along the tie member is substantially prevented.

7. The method of claim 6, further comprising:

providing an elongated tie member extending generally parallel to the studs;

mounting the tie member onto the mounting platform such that movement of the stabilizing member in at least one direction along the tie member is substantially prevented; and securing a portion of the tie member with respect to a building structural member that is vertically adjacent to the shear wall.

8. A shear wall construction, comprising a frame having a pair of generally vertical spaced studs affixed at a lateral end of the frame, the studs being horizontally spaced from one another by between about 1 inch and 6 inches, a stabilizing member sandwiched between the studs and attached to the studs, said stabilizing member configured to selectively engage and disengage an elongated tie member oriented generally parallel to the studs such that, when the stabilizing member is engaged with the tie member, movement of the stabilizing member in at least one direction along the tie member is substantially prevented.

9. The shear wall construction of claim 8, further comprising an elongated tie member extending generally parallel to the studs from the stabilizing member into a vertically adjacent building structural member, the stabilizing member being engaged with the tie member such that movement of the stabilizing member in at least one direction along the tie member is substantially prevented.

10. The shear wall construction of claim 8, wherein the stabilizing member defines a channel extending within the stabilizing member.

11. The shear wall construction of claim 10, wherein the channel extends generally parallel to the studs.

12. A method of constructing a shear wall, comprising:

providing a pair of generally vertical studs, horizontally spaced from one another by between about 1 inch and 6 inches, to form a lateral end of the shear wall;

sandwiching a stabilizing member between the studs; and affixing the stabilizing member to both of the studs;

wherein the stabilizing member includes a body that defines a channel within the stabilizing member, the channel configured to receive an elongated tie member oriented generally parallel to the studs.

13. The method of claim 12, wherein the channel extends generally parallel to the studs.

14. The method of claim 13, wherein the stabilizing member is configured to selectively engage and disengage an elongated tie member extending through the channel such that, when the stabilizing member is engaged with the tie member, movement of the stabilizing member along the tie member in at least one direction is substantially prevented.

15. The method of claim 12, further comprising affixing the pair of vertical studs to a planar wall sheet.

16. The method of claim 12, wherein affixing the stabilizing member comprises extending each of a plurality of bolts through both of the pair of studs and through the stabilizing member sandwiched therebetween.

17. The method of claim 12, wherein the stabilizing member includes a mounting platform configured to mount an elongated tie member.

18. The method of claim 17, further comprising:

providing an elongated tie member extending through the channel;

mounting a first portion of the tie member against the mounting platform; and securing a second portion of the tie member with respect to a building structural member that is vertically adjacent to the shear wall.

19. The method of claim 17, wherein the mounting platform comprises an end plate of the stabilizing member.

20. The method of claim 18, wherein the tie member comprises a threaded rod and the first portion of the tie member comprises a nut threaded onto the rod, the nut being mounted against the mounting platform of the stabilizing member.

* * * * *